US007014180B1

(12) United States Patent
Harrison

(10) Patent No.: US 7,014,180 B1
(45) Date of Patent: Mar. 21, 2006

(54) WARPAGE CONTROL METHOD AND APPARATUS

(76) Inventor: Douglas W. Harrison, P.O. Box 992, Jal, NM (US) 88252

( * ) Notice: Subject to any disclaimer, the term of this patent is extended or adjusted under 35 U.S.C. 154(b) by 293 days.

(21) Appl. No.: 10/665,635

(22) Filed: Sep. 17, 2003

(51) Int. Cl.
*B25B 27/14* (2006.01)

(52) U.S. Cl. ..... 269/17; 269/47

(58) Field of Classification Search ..... 269/17, 269/69, 296, 47
See application file for complete search history.

(56) References Cited

U.S. PATENT DOCUMENTS

| | | | | |
|---|---|---|---|---|
| 3,831,511 | A | 8/1974 | Back | |
| 4,022,094 | A | 5/1977 | Hetherington | |
| 5,505,425 | A * | 4/1996 | Shelton | 248/670 |
| 6,322,061 | B1 * | 11/2001 | Maser et al. | 269/17 |
| 6,863,271 | B1 * | 3/2005 | Clouser | 269/71 |

* cited by examiner

*Primary Examiner*—Lee D. Wilson

(57) ABSTRACT

Method and apparatus for storing stacks of lumber to avoid or correct warpage utilizing two or more rectangular or square frameworks, open throughout which may include linkage for maintaining a fixed spacing of the frameworks and/or rollers for mobility in handling the stacks of lumber. A side of each framework may be hinged for opening and include a latch mechanism for securing such side from opening. Two adjacent sides of each framework each mount a force actuator having a flat face member supported within the interior periphery of each framework for engagement with the exposed surface of the stacks of lumber positioned within and extending between the two or more frameworks which upon activation of the force actuator squeezes the stack of lumber in two directions, thereby avoiding or correcting warpage during storage of the stacks of lumber. Further, where the stack of lumber does not present a uniform exposed adjacent surfaces filler blocks are used to provide such surfaces initially or whenever a price of lumber is removed from the stack.

19 Claims, 3 Drawing Sheets

85

WARPAGE CONTROL METHOD AND APPARATUS

BACKGROUND OF THE INVENTION

1. Field

This invention relates to a system of storing stacks of lumber under compressive force to avoid or correct warpage. In more detail, the system includes providing several open frameworks for use in compressing regular or irregular stacks of lumber. The frameworks are spaced at predetermined distances apart depending on the condition of the lumber being stored.

2. State of the Art

In the past, lumber is generally shipped in stacks and held tightly bound by metals straps or ribbon that encircle the stack of lumber. In this fashion, the metal straps tend to retain newly milled lumber in a flat or un-warped condition. Once the stack of lumber is in storage by the retailer, the metal straps are removed to accommodate sales to customers and no retention force is provided to the stacks of regular or irregular seasoned or unseasoned lumber. Thus, the lumber making up the stacks is subjected to the environment without the metal bands surrounding it thus permitting warpage to some extent.

U.S. Pat. No. 3,831,511, issued to Carl Back, describes an apparatus for delivering lumber though a compressing mechanism by conventional conveyor for moving the lumber into the mechanism and another conveyor for moving the lumber out of the mechanism. The lumber is compressed in a vertical direction by a pressing beam being lowered to contact the upper surface of a bundle of lumber and then a second pressing beam being moved upwardly from underneath to compress the lumber. A third pressing beam moves in the horizontal direction to engage the lumber bundle with the lumber being compressed. A binding device operates to put a band around the lumber while it is under compression. As needed, more than one band may be applied by moving the lumber bundles through the compressing mechanism in several stages where a band or metal strip is applied at each stage. It is apparent such a technique is only successful in avoidance or correction of lumber warpage while the bands or metals strips remain in place.

U.S. Pat. No. 4,220,094 issued to a Ronald Hetherington describes a trimmer machine for trimming lumber packages. Primarily the trimmer is used for trimming packaged lumber to standard lengths without removing metal bands or the like, which are the usual packaging arrangement for shipment of lumber bundles.

SUMMARY OF THE INVENTION

The invention provides post shipment arrangement for maintaining stacks of lumber under compression to avoid or correct warpage as the stacks of lumber are sold piece by piece and the stacks of lumber are reduced form a normal stack to irregular pieces or boards whereby the retailer prevents or corrects warpage of the remainder of the stacks of lumber as it is being sold piece by piece.

The system of the invention for retaining full or partial stacks of lumber free from or remedial of warpage utilizes several frameworks designed in rectangular or square shapes with an open interior periphery designed to support regular or irregular stacks of lumber as it is being removed for sale from the un-banded stacks of lumber stored under compression force.

The method of avoiding or correcting warpage of lumber in stacks includes utilizing several frameworks formed in the shape of a rectangle or square which defines an interior periphery with channels to guide a pair of compression mechanisms in transverse paths for applying compressive force on the stacks of lumber even for irregular stacks by utilizing filler blocks with the stacks of lumber to provide a square or rectangular shape within the interior periphery thereby providing uniform compressive force on the remaining pieces of lumber in the stacks of lumber.

The method of maintaining irregular stacks of lumber under compressive force to avoid or correct warpage of the individual pieces of lumber remaining in a stack of lumber which has been un-banded for sale of some of the lumber in the stack to retail customers that includes providing a framework in the form of a rectangular or square including force applying mechanisms supported from two adjacent sides of the framework for compressing lumber extending within and between two such frameworks to simulate a piece of lumber so the force applying mechanism evenly distributes the compressive force.

In another aspect, a system of frameworks each in the shape of a rectangle or square, respectively, with a screw-drive mechanism supported from the same two adjacent sides of each framework to apply compressive force within the interior periphery against a stack of lumber extending within and between each framework as necessary to avoid or correct warpage in the stack of lumber, when lumber is removed from the stack which may create uniform or non-uniform faces or edges filler block may be use to present uniform faces and edges for application of uniform compressive forces to avoid or correct for warpage.

Further, two or more frameworks may be linked by a bar or beam extending between the bottoms to separate the frameworks by a desired distance compatible with avoiding or correcting warpage in a stack of lumber. The frameworks may be provided feet to elevate the frameworks, roller for mobility, brackets for mounting to a vertical wall, beam or structure, as well as handles for smaller stacks of lumber stored by a consumer for later use. The frameworks may include double track interior peripheries for guiding compressive force mechanisms in transverse directions for applying compressive force to the stack of lumber.

DESCRIPTION OF THE PREFERRED EMBODIMENT(S)

Figures 1, 2, 3:
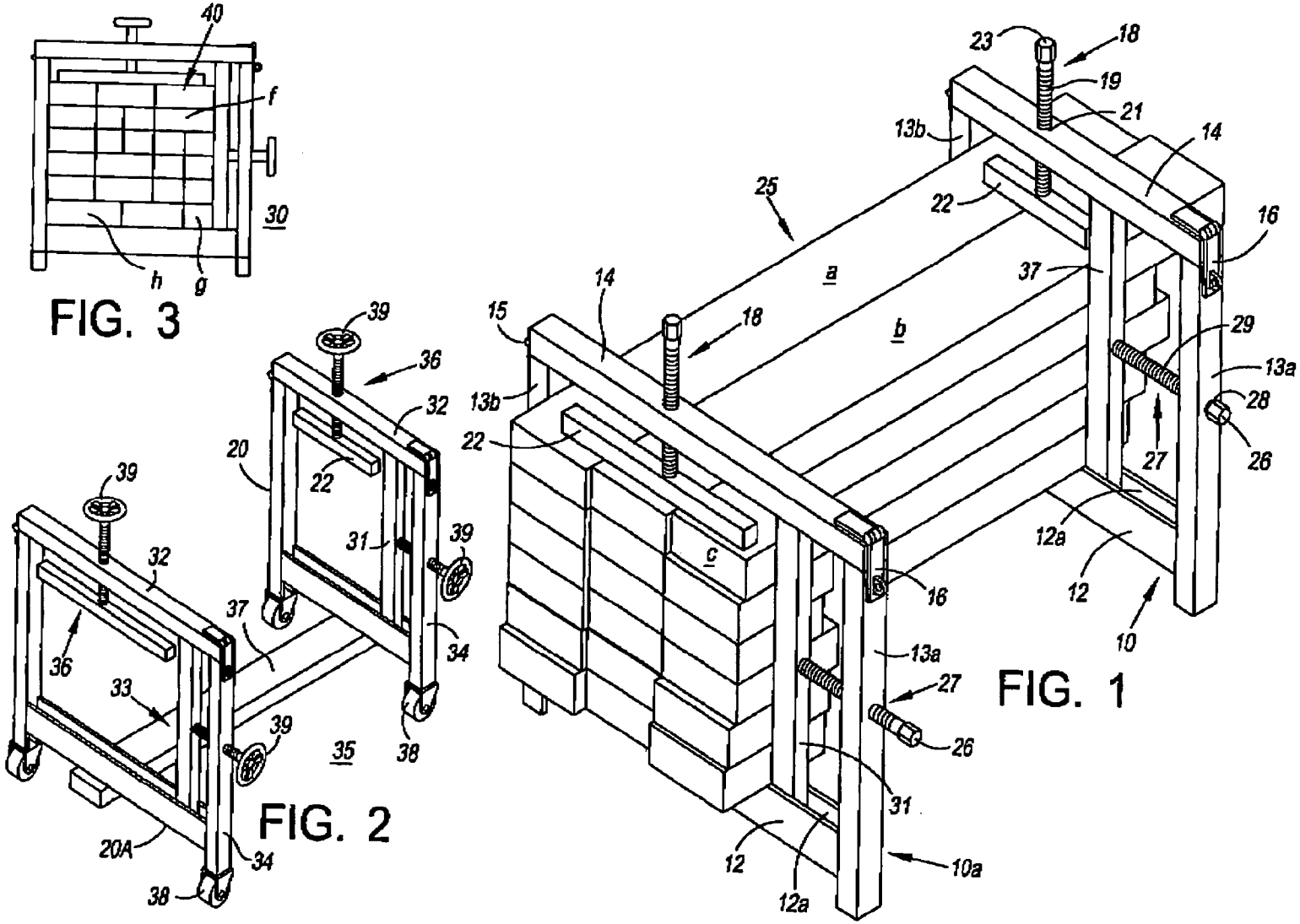
FIG. 1 illustrates in perspective a partial stack of lumber stored in accordance with the invention.
FIG. 2 is a perspective view of a pair of frameworks with optional rollers linked together for practicing the method for storing lumber.
FIG. 3 is an end view of different size lumber stacked under compression.

Referring now to the drawings and in particular FIGS. 1 through 3, frameworks 10 and 10*a* include base 12, side posts 13*a* and 13*b*, and top14 having hinge 15 and latch 16. Force mechanism 18 is mounted in top 14 and includes screw 19 with head 23 threaded in aperture 21 and connected to flat member 22 by a loss motion coupling. Upon rotating head 23 of screw 19, flat member 22 transversely engages boards a and b of lumber stack 25. Force mechanism 27 includes screw 29 with head 26 threaded in aperture 28 of side post 13*a* and connected to flat member 31 by loss motion coupling. Base 12 of framework 10 has channel 12*a* which guides flat face member 31 against board b and those stacked under board b to apply force on stack 25 to the sides of the boards. Framework 10*a* is similar to framework 10 but slightly larger. It has base 12 with channel 12*a*, top 14 with force mechanism 18, and side posts 13*a* and 13*b* with force mechanism 27 the same as framework 10. Filler block c and those stacked thereunder engage the side of board b and those thereunder. Flat member 31 of force actuator 27 mounted on side post 13*a* of framework 10*a* engages filler block c and those thereunder.

FIG. 2, illustrates warpage controller 35, which consists of framework 20 and framework 20A, which are identical with each other, linked together by spacer 37 to maintain a pres-selected separation according to the boards in a particular stack as to their length and extent of any warpage. Optional rollers 38 are provided on frameworks 20 and 20A, respectively, which provides mobility to warpage controller 35. Frameworks 20 and 20A each have force actuator 36 mounted in tops 32 and force actuator 33 mounted in side posts 34, respectively, similar to force mechanism 18 and force mechanism 27, respectively, in FIG. 2, except hand wheels 39 replace heads 23 of screws 19 for applying force on flat members 22 and 31 and in turn onto a stack of lumber when it is positioned within and between frameworks 20 and 20A.

In FIG. 3, stack of lumber 40 includes mixed board sizes f, g and h which have been loaded in warpage controller 30 that is similar to warpage controller 35 without rollers.

Figure 4:
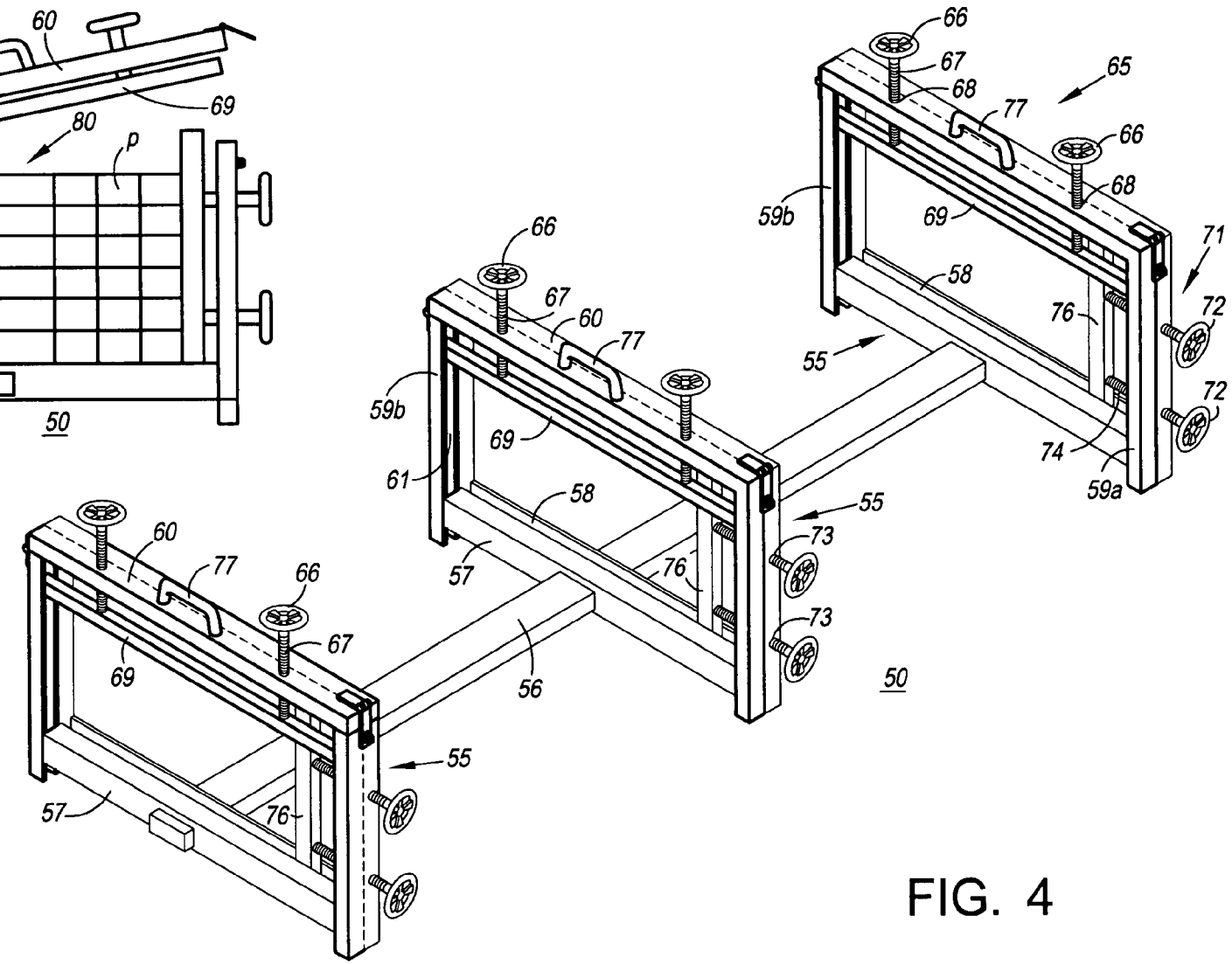
FIG. 4 is a perspective view similar to FIG. 2 illustrating three open frameworks for storing lumber under compression.
Figure 5:
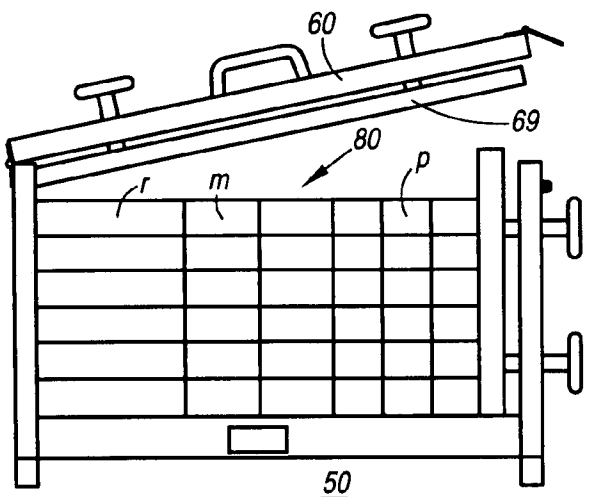
FIG. 5 is an end view showing the top of the framework partially raised for the insertion of lumber.
Figures 6, 7:
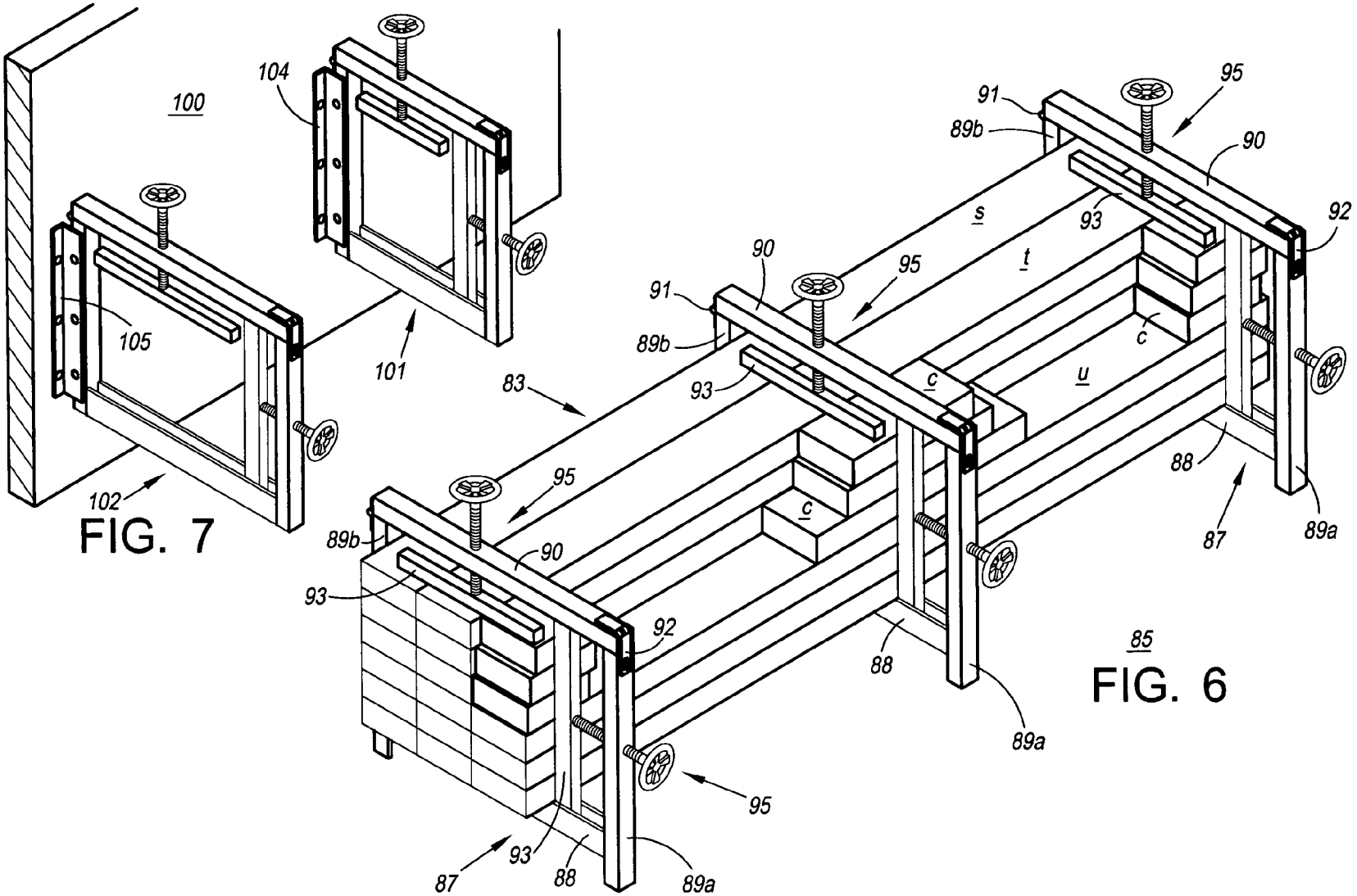
FIG. 6 is a perspective view similar to FIG. 4 illustrating using stack fillers for compressing lumber.
FIG. 7 is a perspective view similar to FIG. 2 illustrating the framework attached to a vertical structure.

Referring to FIGS. 4, 5 and 6, warpage controller 50 includes three frameworks 55, which are connected together by central member 56. This arrangement provides three identical frameworks 55 for controlling severe warpage with intermediate framework 55 positioned anywhere along the length of central member 56 based on the condition of the lumber to be stored. Primarily, each framework 55 include base 57, with channel 58, side rail 59*a* and 59*b* with channel 61. Top 60 of each framework 55 include force actuator 65 consisting of two hand wheels 66 attached to two screws 67, which are retained within threaded apertures 68 and attached to bar 69 by loss motion coupling and is guided in channels 61. Similarly side rail 59*a* of each framework 55 supports force actuator 71, similar to force actuator 65, and include two hand wheels 72 attached to two screws 74 which are retained within threaded apertures 73 in side rail 59*a* and attached to bar 76 by loss motion members. Bar 76 is guided in channel 58 of base 57. For convenience of movement, handles 77 are provided on frameworks 55. FIG. 5 illustrates warpage controller 50 with top 60 opened for placing a stack of mixed lumber 80 comprised of mixed board sizes r, m and p.

Referring to FIG. 6, warpage controller 85 includes three equal size frameworks 87 each having base 88, side rails 89*a* and 89*b*, and top 90. Each top 90 has hinge 91 similar to hinge 15 and latch 92 similar to latch 16 (see FIG. 1). Each framework 87 has force actuator 95 similar to force actuators 36 and 33 (see FIG. 2). In FIG. 6, warpage controller 85 retains an irregular lumber stack 83, which includes board layers s, t and u. Board layer u has less boards than board layers s and t hence filler blocks c have been placed on top of board layer u within each framework 87 such that the flat members 93 of force actuators 95 equally compress board layers s, t and u with the aid of filler blocks c.

As seen in FIG. 7, framework 101 and 102 are attached by brackets 104 and 105, respectively, to vertical structure or wall 100. This mounting would require structure 100 and brackets 104 and 105 to be of suitable construction to support stacks of lumber to be stored. Other mounting arrangement than that shown are possible so long as such would support the maximum load exerted by a stack of lumber being stored. Framework 101 and framework 102 are similar to framework 87 including force actuators 95, the only difference being the attachment to structure 100.

The construction of various warpage controller heretofore described provide the necessary frameworks for the method of avoiding or correcting warpage in stacks of lumber, such as lumber stack 25, lumber stack 26, lumber stack 40 and lumber stack 80. Referring to FIGS. 1 through 3, in a particular situation where only two frameworks 10 and 10*a*, one being smaller then the other, are the only frameworks available for use filler blocks c are required. Two layers of boards a and b with the same number and size are positioned between and within frameworks 10 and 10*a*. The area of board layers a and b within frame 10 are compressed by operating force mechanism 18 such that flat member 22 engages both board layers a and b. Also force mechanism 27 on framework 10 is operated to apply force by flat member 31 to the edges of board layer b only. Since frame 10*a* is larger than 10, in order to compress the area of board layers a and b and the edges of board layer b, filler members c are positioned in framework 10*a* in abutment with the edges of board layer b and force mechanism 18 and force mechanism 27 are operated to apply force by flat member 22 and flat member 31 to board layers a and b and filler members c and the edges of filler members c, respectively. Flat member 22 is sufficient to apply force to board layers a and b and filler members c.

Considering the warpage controller 85 in FIG. 6, the functioning of the method and apparatus is described. Lumber stacks, such as lumber stack 83, are packaged with steel bands encircling the stack which are removed as the lumber is sold. The method using the apparatus heretofore described, includes receiving a bundle of lumber, opening tops 90 by releasing latches 92, pivoting tops 90 open wide, withdrawing flat members 93 of force actuators 95, placing stack 83 in warpage controller 85, closing and latching tops 90 and applying compressive force on the surface and edge of lumber stack 83 by use of force actuators 95.

As lumber from lumber stack 83 is sold by a lumber retailer or use by a consumer a few boards at a time, board layers s, t and u become irregular and to avoid or correct warpage, filler members c are positioned within frameworks 87 as in FIG. 6 such that the remainder of lumber stack 83 may be compressed. The filler blocks preferable are scraps of the same lumber or of suitable other materials or compatible lumber like hardwood with hardwood or pine with pine. Further, various stacks of different size lumber may be mixed to take advantage of the method of to avoid or correct warpage (see FIGS. 3 and 5).

The roll-a-round warpage controller 35 in FIG. 2 and the vertical structure or wall 100 support in FIG. 7 are suited for retailers or consumers that stock lumber for long periods between usage. In FIG. 1, heads 23 of force mechanism 18 and heads 26 of force mechanism 27 may be operated by a torque wrench if it is desired to get a specific or controlled compression on the stack of lumber. Also, power operated force actuators may replace those illustrated and described herein.

Having heretofore disclosed and preferred embodiment, it will be understood that in general the method of avoiding or correcting warpage while storing lumber stacks for sale to consumers or for home use over extended periods requires providing suitable rectangular or square frameworks or holders which allow compression of the boards of lumber stored for later sale or use. Force actuators are provided on adjacent sides of the frameworks to apply force to the surface and edge of stored lumber. The frameworks may be linked together separated by a predetermined distance depending on the condition of the lumber. The frameworks have pivotal tops, which are releasable latched to allow opening to store or remove lumber and then closed to operate the force actuators. As boards are used from the stack filler members are added to provide uniformity for compressing the remainder of the stack. Likewise, mixed size lumber from different stacks may be combined in the same stack. The force applied by the force actuator is the minimum necessary to flatten the stack within the warpage controller. The method of avoiding or correcting warpage may readily be applied to mixed stacks of lumber so long as with or without using filler members the mixed stack of lumber present a surface and edge for uniform engagement by the flat members of the force actuators.

The invention claimed is:

1. A lumber storing device for avoiding or correcting warpage of lumber comprising:

(a) a series of at least two frameworks;

(i) each having a bottom, two sides and a top forming right angles, (ii) the bottom, top and sides of each framework defining an interior periphery, (iii) at least one aperture in each top and in one of the two sides of each framework, (b) a flat face member supported within each framework from each aperture by a force mechanism for moving each such flat face members inward and outward transverse to each other; and (c) each flat face member designed upon inward movement to engage uniform surfaces of a stack of lumber or lumber and a block of material positioned between and within the interior periphery of each of said series of at least two frameworks with sufficient force to maintain the pieces of lumber free of warpage.

2. The device of claim 1 wherein the top is hinged to one side and releasably attached to the other side of each framework.

3. The device of claim 1 wherein the force mechanism is a screw drive mechanism.

4. The device of claim 1 wherein each framework includes symmetrical members for supporting each framework from an upright structural surface.

5. The device of claim 1 wherein each framework is rectangular or square in shape.

6. The device of claim 5 wherein a linkage member retains each rectangular or square framework linked to each other spaced apart.

7. The device of claim 6 wherein each framework includes a pair of rollers mounted to the bottom thereof.

8. The device of claim 1 wherein each of the frameworks of the series of at least two frameworks are spaced apart sufficiently to avoid or correct warping.

9. In a method of storing stacks of lumber to avoid or correct warpage, the improvement comprising;

(a) providing at least two rectangular frameworks space spaced apart, each defining an interior periphery with channels therein and open throughout for supporting a stack of lumber within and therebetween;

(b) mounting on each framework a horizontal force mechanism and a vertical force mechanism, each mechanism includes an arm and flat faced member for transverse movement, relatively to each other, within the confines of the interior periphery;

(c) placing a stack of lumber extending between and within each framework; and (d) activating the horizontal force mechanism and the vertical force mechanism to move each such flat face member into engagement with uniform exposed surfaces of the stack of lumber with a compressive force sufficient to avoid or correct warpage.

10. The method according to claim 9 wherein the stack of lumber is placed extending between and within each rectangular framework through a hinged and latching side of each rectangular framework.

11. The method according to claim 9 wherein filler blocks are placed in each rectangular framework to form a uniform exposed surface for engagement by each flat face member.

12. The method according to claim 9 wherein rollers are mounted on each of the frameworks to provide mobility to the stack.

13. The method according to claim 9 wherein brackets are secured to each framework for mounting them to an upright structure.

14. A method of storing lumber in stacks to avoid or correct warpage comprising:

(a) providing a pair of spaced apart frameworks adapted to accommodate a stack of lumber therein and therebetween;

(b) designing each framework as a rectangle or square defining an interior periphery;

(c) mounting, on each framework, a pair of actuators each having a flat face member for inward and outward movement transverse with each other within the interior periphery of the framework:

(d) securing the frameworks spaced apart with a connector member;

(e) stacking lumber to form a uniform stack extending between and within the interior periphery of each of the pair of frameworks; and (f) activating the actuators for inward movement of the flat face members to engage the uniform stack and apply sufficient compression to avoid or correct warpage.

15. The method according to claim 14 wherein the connector member retains the pair of frameworks spaced apart a sufficient distance to accommodate avoidance or correction of warpage of the stack.

16. The method according to claim 14 wherein lumber may be withdrawn from the stack and replaced by a block of material within each framework thereby retaining the uniformity of the stack within each framework.

17. The method according to claim 16 wherein the block of material is lumber.

18. The method according to claim 16 wherein the block of material is other than lumber subject to warpage.

19. The method of claim 14 wherein lumber may be withdrawn from the stack and replaced by other lumber from different stacks.

* * * * *